United States Patent [19]

Sakanoue et al.

[11] 4,267,250

[45] May 12, 1981

[54] COLOR DIFFUSION TRANSFER PHOTOGRAPHIC ELEMENT

[75] Inventors: Seiki Sakanoue; Kokichi Waki; Motohiko Tsubota; Osamu Takahashi; Asao Nakatsuka, all of Minami-ashigara, Japan

[73] Assignee: Fuji Photo Film Co., Ltd., Minami-ashigara, Japan

[21] Appl. No.: 83,706

[22] Filed: Oct. 11, 1979

[30] Foreign Application Priority Data

Oct. 12, 1978 [JP] Japan ..... 53-125600

[51] Int. Cl.[3] ..... G03C 1/40; G03C 1/10; G03C 5/54; G03C 1/76

[52] U.S. Cl. ..... 430/214; 430/223; 430/502; 430/505; 430/523; 430/539; 430/559

[58] Field of Search ..... 430/214, 223, 505, 539, 430/523, 559, 502

[56] References Cited

U.S. PATENT DOCUMENTS

| | | | |
|---|---|---|---|
| 4,124,394 | 11/1978 | Sera et al. | 430/214 |
| 4,192,678 | 3/1980 | Chasman | 430/214 |

OTHER PUBLICATIONS

"Photographic Processes and Products", *Research Disclosure*, No. 15162, 11/1976, pp. 75–87.

*Primary Examiner*—Richard L. Schilling
*Attorney, Agent, or Firm*—Sughrue, Rothwell, Mion, Zinn and Macpeak

[57] ABSTRACT

In a color diffusion transfer photographic element containing at least one dye-releasing redox compound-containing layer associated with a silver halide photographic emulsion and capable of releasing a diffusible dye as a result of a redox reaction with the oxidation product of a developing agent produced by the development of silver halide with an alkaline processing solution, and at least one layer containing an antistain agent, the improvement which comprises said dye-releasing redox compound-containing layer associated with said silver halide photographic emulsion being spaced from the adjacent interlayer containing said antistain agent by a spacer layer essentially containing a hydrophilic colloid or by a silver halide emulsion layer having substantially the same spectral sensitivity as that of the associated silver halide emulsion.

15 Claims, No Drawings

COLOR DIFFUSION TRANSFER PHOTOGRAPHIC ELEMENT

BACKGROUND OF THE INVENTION

1. Field of the Invention

This invention relates to a color diffusion transfer photographic element.

2. Description of the Prior Art

In preparing multicolor transferred images using dye image-providing materials of the type which release a diffusible dye as a result of a redox reaction between the oxidation product of a developing agent formed by the development of silver halide and a dye-releasing redox compound, as described in U.S. Pat. Nos. 4,152,153, 3,928,312 and 3,993,638 and light-sensitive element contains three combinations of a dye-releasing redox compound and associated light-sensitive silver halide emulsion layer (hereafter "dye-releasing redox compound-containing light-sensitive units"). On the image-receiving layer, the dye released from the dye-releasing redox compound shows a light absorption which substantially coincides with the spectral sensitivity of the silver halide emulsion associated with the dye-releasing redox compound (The dye may be temporarily shifted to a shorter wavelength prior to the development processing).

It is needless to say that the oxidation product of the developing agent formed by the development of silver halide must act only on the dye-releasing redox compound associated with the emulsion layer. It has been known as described, for example, in *Research Disclosure,* Vol. 152, No. 15162, published in Nov. 1976, to provide an interlayer between the three dye-releasing redox compound-containing light-sensitive units in the photographic element containing a material such as an antistain agent like a diffusion-resistant hydroquinone derivative which is capable of properly reacting with the oxidation product of the developing agent to prevent the oxidation product of the developing agent from diffusing into an unassociated dye-releasing redox compound-containing layer.

However, when a photographic element containing a dye-releasing redox compound-containing layer and an adjacent antistain agent-containing layer is photographically processed after storage especially under high temperature and high humidity conditions, there often results a reduction in maximum density ($D_{max}$). The reason for this is not completely clear, but it seems to be attributed to diffusion of the dye-releasing redox compound and/or the antistain agent into other layers during storage, e.g., the dye-releasing redox compound entering the antistain agent-containing layer or the antistain agent entering the dye-releasing redox compound-containing layer.

SUMMARY OF THE INVENTION

A principal object of the present invention is to provide a photographic element for use in the color diffusion transfer process, which does not suffer a substantial reduction in maximum color density ($D_{max}$) upon storage.

The present invention is based on the discovery that the storage stability of a light-sensitive material can be remarkably improved by providing, between the dye-releasing redox compound-containing layer associated with a silver halide photographic emulsion layer and the adjacent antistain agent-containing layer, a spacer layer containing gelatin as a major component or a layer containing a silver halide emulsion having the same color sensitivity as that of the silver halide emulsion associated with the dye-releasing redox compound in the layer adjacent the antistain agent-containing layer. That is, the above-described object of the present invention can be attained by a color diffusion transfer photographic element containing at least one dye-releasing redox compound-containing layer associated with a silver halide photographic emulsion and capable of releasing a diffusible dye as a result of a redox reaction between the oxidation product of a developing agent produced upon the development of silver halide with an alkaline processing solution, and at least one layer containing an antistain agent, said dye-releasing redox compound-containing layer and associated silver halide photographic emulsion being spaced from the adjacent interlayer containing said antistain agent by a spacer layer containing a hydrophilic colloid as a major component or a silver halide emulsion-containing layer having substantially the same spectral sensitivity as that of the silver halide emulsion associated with the dye-releasing redox compound.

More specifically, the present invention relates to a photographic element comprising a transparent support having provided thereon, in sequence, an image-receiving layer, a light-intercepting layer, a reflective layer, a cyan dye-releasing redox compound-containing layer associated with a red-sensitive silver halide emulsion, an antistain agent-containing layer, a magenta dye-releasing redox compound-containing layer associated with a green-sensitive silver halide emulsion, an antistain agent-containing layer, and a yellow dye-releasing redox compound-containing layer associated with a blue-sensitive silver halide emulsion; which forms, upon being treated with an alkaline processing solution, an imagewise distribution of diffusible dyes as a result of a redox reaction between the oxidation product of the developing agent formed through development of the silver halide and the dye-releasing redox compounds, followed by diffusion of the dyes into the image-receiving layer to form a color image, wherein the dye-releasing redox compound-containing layers associated with the silver halide photographic emulsions is spaced from the antistain agent-containing layer adjacent the redox compound-containing layer by a layer containing gelatin as a major component or by a silver halide emulsion layer having the same color sensitivity as that of the silver halide emulsion associated with the aforesaid adjacent dye-releasing redox compound.

In a more preferred embodiment of the present invention, the photographic element has the following multilayered structure (in sequence from the top of the element):

Protective layer
Blue-sensitive silver halide emulsion layer
Yellow dye-releasing redox compound-containing layer
Spacer layer
Layer containing a diffusion-resistant antistain agent
Green-sensitive silver halide emulsion layer
Magenta dye-releasing redox compound-containing layer
Spacer layer
Layer containing a diffusion-resistant antistain agent
Red-sensitive silver halide emulsion layer
Cyan dye-releasing redox compound-containing layer
Light-intercepting layer containing a black pigment Reflective layer containing a white pigment
Mordant layer containing a dye-mordanting agent

DETAILED DESCRIPTION OF THE INVENTION

In accordance with the present invention a spacer layer may be located on both sides of the antistain agent-containing layer which separates each of the light-sensitive dye-releasing redox compound-containing units which generally make up a diffusion transfer photosensitive element. However, generally the light-sensitive dye-releasing redox compound-containing unit is constructed of a first layer containing the dye-releasing redox compound located within the unit nearest the image-receiving layer and a second layer which is a silver halide emulsion layer having a sensitivity corresponding to the dye released by the dye-releasing redox compound. In this case a spacer layer is not required on each side of the antistain agent-containing layers which separate each of the light-sensitive dye-releasing redox compound-containing units making up the element. A spacer layer is located between the antistain agent-containing layer and what would be an adjacent dye-releasing redox compound-containing layer, but a spacer layer is not required between the antistain agent-containing layer and the adjacent silver halide emulsion layer which is associated with one of the other dye-releasing redox compounds in the element. Of the two basic embodiments of the present invention, i.e., that in which the spacer layer is essentially a hydrophilic colloid layer and that in which the spacer layer is a silver halide emulsion, the essentially hydrophilic colloid layer is preferred.

In the case of the layer sequence which is generally encountered in conventional diffusion transfer materials, storage stability of the photographic element of the present invention is improved by interposing a spacer layer between a yellow dye-releasing redox compound-containing layer and an antistain agent-containing layer, and between a magenta dye-releasing redox compound-containing layer and an antistain agent-containing layer according to the present invention. In particular, when the photographic element is subjected to sensitometry after storage for a definite period of time under the conditions of high temperature and high humidity, it suffers extremely lower reduction in maximum dye density ($D_{max}$) as compared with a photographic element containing no spacer layers. One reason for this improved effect is supposedly because the spacer layers depresses migration of the dye-releasing redox compound from the dye-releasing redox compound-containing layer to the antistain agent-containing layer and migration of the antistain agent from the antistain agent-containing layer to the dye-releasing redox compound-containing layer. When oil-soluble additives which are liquid at temperatures of about 45° C. or higher are incorporated in the dye-releasing redox compound-containing layer and/or the antistain agent-containing layer in an amount of not less than ½ of gelatin contained in the dye-releasing redox compound-containing layer and/or the antistain agent-containing layer (total weight of oil-soluble additives), photographic elements containing no spacer layers suffer a particularly serious reduction in maximum density ($D_{max}$) and, in this case, the photographic element of the present invention exhibits particularly remarkable effects.

The term "oil-soluble additives" as used herein means those additives including dye-releasing redox compounds, antistain agents, high-boiling solvents for dispersion, surfactants, etc.

In accordance with one embodiment of the present invention the spacer layer is a hydrophilic colloid layer. The hydrophilic colloid may be gelatin, a gelatin derivative, a protein, a cellulose derivative, or a synthetic hydrophilic high molecular material, examples of which are set forth in more detail below. The hydrophilic colloid used for the spacer layer, however, is preferably gelatin. As gelatin, acid-processed gelatin and enzyme-processed gelatin described in *Bull. Soc. Sci. Phot. Japan,* No. 16, p. 30 (1966) may be used as well as lime-processed gelatin. Further, hydrolyzates or enzyme-decomposition products of gelatin may be used. As gelatin derivatives, those obtained by reacting gelatin with various compounds such as acid halides, acid anhydrides, isocyanates, bromoacetic acid, alkanesulfones, vinylsulfonamides, maleinimides, polyalkylene oxides, epoxy compounds, etc., may be used. Specific examples thereof are described in U.S. Pat. Nos. 2,614,928, 3,132,945, 3,186,846 and 3,312,553, British Pat. Nos. 861,414, 1,033,189 and 1,005,784, Japanese Patent Publication No. 26845/67, etc.

As hydrophilic colloids other than gelatin, there can be used graft polymers between gelatin and other high polymers; proteins such as albumin, casein, etc.; cellulose derivatives such as hydroxyethyl cellulose, carboxymethyl cellulose, cellulose sulfates, etc.; sugar derivatives such as sodium alginate, starch derivatives, etc.; various synthetic and hydrophilic homo- or copolymers such as polyvinyl alcohol, partially acetallized polyvinyl alcohol, poly-N-vinyl pyrrolidone, polyacrylic acid, polymethacrylic acid, polyacrylamide, polyvinyl imidazole, polyvinyl pyrazole, etc.

As the above-described gelatin graft polymer, there can be used those prepared by grafting to gelatin a homo- or copolymer of a vinyl series monomer such as acrylic acid, methacrylic acid, derivatives thereof such as esters or amides, acrylonitrile, styrene, etc. Of these, graft polymers with a polymer having a compatibility with gelatin to some extent, such as a polymer of acrylic acid, methacrylic acid, acrylamide, methacrylamide, hydroxyalkyl methacrylate, etc., are preferred. Examples thereof are described in U.S. Pat. Nos. 2,763,625, 2,831,767, 2,956,884, etc.

Typical synthetic hydrophilic high molecular materials are described in, for example, West German Patent Application (OLS) No. 2,312,708, U.S. Pat. Nos. 3,620,751 and 3,879,205, and Japanese Patent Publication No. 7561/68.

The spacer layer of the present invention can incorporate a coating aid or surfactant, a hardener, a thickening agent, a matting agent, etc. In some cases, a high-boiling solvent for dispersion (e.g., tri-o-cresyl phosphate, N,N'-diethyllaurylamide, etc.) may be incorporated as long as migration of the dye-releasing redox compound and/or the antistain agent between the dye-releasing redox compound-containing layer and the antistain agent-containing layer does not occur. However, the spacer layer preferably does not contain such a high-boiling solvent. The thickness of the spacer layer is about 0.05μ to 5μ, preferably about 0.2μ to 1μ.

Any of silver bromide, silver, bromoiodide, silver chlorobromoiodide, silver chlorobromide, and silver chloride may be used as the silver halide in the photographic emulsions in the photographic light-sensitive material used in the present invention. A silver halide emulsion layer having the same spectral sensitivity (color sensitivity) as that of the silver halide emulsion associated with the dye-releasing redox compound in the layer adjacent the antistain agent-containing layer is used as a spacer layer in a thickness of about 0.05μ to 5μ, preferably about 0.2μ to 1μ.

The silver halide grains may be regular crystals such as cubic or octahedral crystals, or irregular crystals such as spherical or plate-like crystals, or they may be of a mixed form. Further, they may comprise a mixture of grains with various crystal forms. The mean particle size of the silver halide grains in the photographic emulsion (the particle size of spherical or approximately spherical grains being the particle diameter, whereas the particle size of cubic grains being the edge length; and the mean particle size being represented as the average based on a projected area) is not particularly limited, but is preferably not more than about 3μ. The particle size distribution may be either narrow or broad.

The inner and exterior portions of the silver halide grains may be different phases or comprise a uniform phase. The silver halide may be a surface latent image type silver halide, i.e., one which forms a latent image mainly on the surface; or, as described in U.S. Pat. Nos. 2,592,550, 3,206,313, etc., inner latent image type grains forming a latent image mainly inside the grain. In practicing the present invention, a photographic emulsion containing inner latent image type silver halides is preferred.

The silver halide photographic emulsion used in the present invention can be prepared according to the processes described in P. Glafkides, *Chimie et Physique Photographique* (published by Paul Montel, in 1967), G. F. Duffin, *Photographic Emulsion Chemistry* (published by The Focal Press in 1966), V. L. Zelikman et al, *Making and Coating Photographic Emulsion* (published by The Focal Press in 1964), etc. That is, silver halide emulsions prepared according to any of an acidic process, neutral process, and ammoniacal process may be used. Regarding the manner of reacting the soluble silver salt with the halide, any of a single-jet mixing process, a double-jet mixing process, or combination thereof, etc., may be employed.

It is also possible to employ a process of forming grains in the presence of excess silver ion (a so-called reverse-mixing process). As one of the simultaneously mixing processes, a process of maintaining the pAg of the liquid phase in which the silver halide is formed at a constant level, i.e., a so-called controlled double-jet process, can be used. This process provides a silver halide emulsion containing silver halide grains having a regular crystal form and an approximately uniform particle size.

It is further possible to mix and use two or more silver halide emulsions prepared separately.

During the formation or physical ripening of the silver halide grains, cadmium salts, zinc salts, lead salts, thallium salts, iridium salts or complex salts, rhodium salts or complex salts, iron salts or complex salts, etc., may be added to the system.

In the light-sensitive element of the present invention, the silver halide photographic emulsion may be spectrally sensitized to comparatively longer wavelength blue light, green light, or red light with sensitizing dyes. As the sensitizing dyes, there can be used cyanine dyes, merocyanine dyes, complex cyanine dyes, complex merocyanine dyes, holopolar cyanine dyes, styryl dyes, hemicyanine dyes, oxonol dyes, hemioxonol dyes, etc. Useful sensitizing dyes are described in, for example, U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,714,828, 3,567,458, 3,625,698, 2,526,632 and 2,503,776, Japanese Patent Application (OPI) No. 76525/73 (The term "OPI" as used herein refers to a "published unexamined Japanese Patent application"), Belgian Pat. No. 691,807, etc.

In the photographic element of the present invention, any of the various supports conventionally used for this type photographic element can be used.

The spacer layer containing essentially a hydrophilic colloid, the antistain agent-containing layer, the dye-releasing redox compound-containing layer, the photographic silver halide emulsion layer, and other hydrophilic colloid layers making up the photographic element of this invention can optionally be hardened with an appropriate hardening agent. Such hardening agents include aldehyde series hardeners such as formaldehyde, mucohalogenic acid, etc., active halogen-containing hardeners, dioxane derivatives, hydroxypolysaccharides such as hydroxy starch, etc., and the like.

The photographic silver halide emulsion layer can contain other additives, particularly useful for the photographic emulsion such as lubricants, antifogging agents, stabilizing agents, sensitizing agents, light-absorbing dyes, plasticizers, etc. The spacer layer of the present invention, antistain agent-containing layer, dye-releasing redox compound-containing layer, and other hydrophilic colloid layer can also contain thickening agents as described in U.S. Pat. No. 3,022,172, etc.

The photographic element of the present invention may contain surfactants for various purposes. Any of nonionic, ionic, and amphoteric surfactants can be used. For example, there are illustrated polyoxyalkylene derivatives, amphoteric amino acids (including sulfobetaines), etc. Such surfactants are described in U.S. Pat. Nos. 2,600,831, 2,271,622, 2,271,623, 2,275,727, 2,787,604, 2,816,920 and 2,739,891, and Belgian Pat. No. 652,862.

The antistain agents used in the present invention include the dihydroxybenzene derivatives described in U.S. Pat. Nos. 2,336,327, 2,360,290, 2,403,721, 3,700,453, 2,701,197, 3,700,453 and 4,121,939 and U.S. Pat. Ser. No. 932,384, etc., dihydroxynaphthalene derivatives, aminonaphthol derivatives, sulfonamidophenol derivatives, sulfonamidonaphthol derivatives, etc. These compounds must contain a ballast group to usefully function as the antistain agent such that they are maintained in the layer in which they are incorporated.

The compounds represented by the following general formula (I) are preferred antistain agents for use in the present invention:

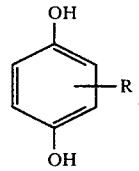

(I)

wherein R represents an alkyl group having 1 to 30 carbon atoms (e.g., methyl, tert-butyl, octyl, tert-octyl, dodecyl, octadecyl, etc.), an aryl group (e.g., phenyl, etc.), an alkoxy group (e.g., methoxy, butoxy, dodecyloxy, etc.), an aryloxy group (e.g., phenoxy, etc.), a carbamoyl group (e.g., methylcarbamoyl, dibutylcarbamoyl, octadecylcarbamoyl, phenylcarbamoyl, etc.), a sulfamoyl group (e.g., methylsulfamoyl, octadecylsulfamoyl, etc.), an acyl group (e.g., lauroyl, etc.), an alkoxycarbonyl group (e.g., methoxycarbonyl, dodecyloxycarbonyl, etc.), a sulfo group, or an aryloxycarbonyl group (e.g., phenyloxycarbonyl, etc.), with the alkyl or aryl moiety in the above-described groups being optionally substituted with a substituent or substituents such as a halogen atom, an alkyl group, an aryl group, an alkoxy group, an aryloxy group, a carboxy group, an alkoxycarbonyl group, an aryloxycarbonyl group, an acyl group, an acyloxy group, a carbamoyl group, a sulfo group, a sulfamoyl group, a sulfonamido group, an N-alkylamino group, an N-arylamino group, an acylamino group, an imido group, a hydroxy group, etc., and one to three of the remaining three hydrogen atoms on the hydroquinone aromatic nucleus being optionally replaced by one to three (which may be the same or different from each other) of the groups defined for R.

The total number of carbon atoms of the substituents on the benzene ring of the general formula (I) is 8 to 40, preferably 15 to 36.

As the specific examples of the compounds, there are illustrated the following, however, these examples are not to be construed as limiting.

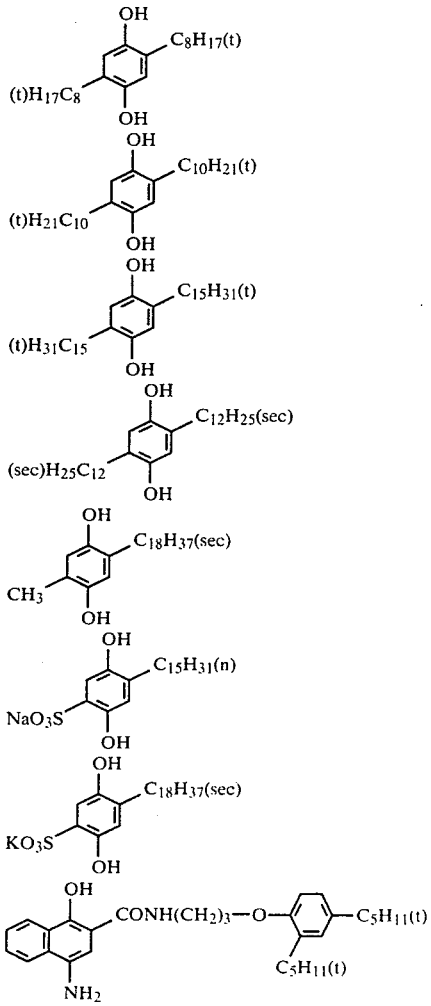

-continued

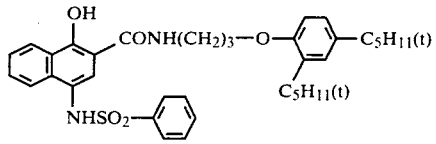

The antistain agent is generally coated in an amount of about $1\times10^{-4}$ to $1\times10^{-2}$ mol/m$^2$, preferably about $5\times10^{-4}$ to $5\times10^{-3}$ mol/m$^2$.

The dye-releasing redox compounds used in the present invention contain a carrier moiety capable of providing a material which possesses a different mobility than the compound per se as a result of oxidation (direct or cross-oxidation) under an alkaline condition. Dye-providing materials used in the present invention can be classified into the following two fundamental groups based on the carrier.

(1) Compounds which are initially diffusion-resistant and at least part of which are made mobile or diffusible by development processing.

(2) Compounds which are initially mobile or diffusible and made immobile by development processing.

Examples of type (1) compounds are described in, for example, U.S. Pat. Nos. 3,928,312, 3,942,987, 3,993,638, 4,055,428 and 4,152,153, Japanese Patent Application (OPI) Nos. 104343/76, 46730/78 and 47823/78, *Research Disclosure,* Vol. 151, No. 15157 (Nov. 1976), ibid., Vol. 130, No. 13024 (Feb. 1975), ibid., Vol. 156, No. 15654 (Apr. 1977), etc.

Examples of type (2) compounds are described in, for example, U.S. Pat. No. 3,980,479.

For the practice of the present invention, dye-releasing redox compounds represented by the following general formula (II) are preferred:

$$Y—(Z)—X \qquad (II)$$

wherein X represents a dye residue or a dye precursor residue bound to Y directly or via a linking group Z, Z represents a linking group such as an alkylene (or alkylidene) group containing 1 to 6 carbon atoms, an arylene group, or a divalent heterocyclic group, and Z is bound to X directly or via —O—, —S—, —$SO_2$—, —$NR_0$—(where $R_0$ in a hydrogen atom or an alkyl group having 1 to 30 carbon atoms), —CO—, —CO—NH—, or —$SO_2$—NH—.

In principle, the above-described dye residue can be a residue of a variety of dyes. This dye residue must have adequate diffusibility to reach an image-receiving layer through photographic layers in the light-sensitive material. For this purpose, one or more water solubility-imparting groups can be bound to this dye residue. Examples of suitable water solubility-imparting groups are a carboxy group, a sulfo group, a sulfonamido group, a sulfamoyl group, an aliphatic or an aromatic hydroxy group, etc. Since a sulfamoyl group can provide the dye molecule with considerably great diffusibility in an alkaline medium after the completion of the decomposition reaction of the dye image-providing material, the presence of additional water solubility-providing group is not always necessary. Examples of dyes particularly suited for the present invention include azo dyes, azomethine dyes, anthraquinone dyes, phthalocyanine dyes, indigoid dyes, triphenylmethane dyes, metal complex dyes, and colored metal complexes.

The aforesaid dye precursor residue is a residue of a compound capable of being converted to a dye by the liberation of an auxochrome (the liberated auxochrome in turn is incorporated in a chromogen) through oxidation within the color-forming system in ordinary or additional photographic processing steps. In this case, the dye precursor may be a leuco dye, or a dye capable of being converted to another dye during photographic processings.

Y represents a moiety capable of providing a dye compound having a different diffusibility from that of the dye image-providing material represented by the formula (II) as a result of development processing under alkaline conditions.

N-substituted sulfamoyl group is an effective example of Y for the compound of the formula (II). For example, there can be illustrated, as Y, those groups represented by the following general formula (A):

(A)

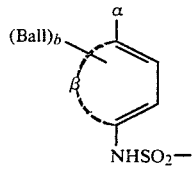

In this formula, $\beta$ represents the non-metallic atoms necessary to form a benzene ring, said benzene ring optionally being fused with a carbon ring or hetero ring to form, for example, a naphthalene ring, a quinoline ring, a 5,6,7,8-tetrahydronaphthalene ring, chroman ring, etc. Further, said benzene ring or fused ring wherein said benzene ring is fused with a carbocyclic ring or hetero ring may be substituted with a halogen atom, an alkyl group, an alkoxy group, an aryl group, an aryloxy group, a nitro group, an amino group, an alkylamino group, an arylamino group, an amido group, a cyano group, an alkylmercapto group, a keto group, a carboxy group, a hetero ring group, or the like.

$\alpha$ represents a group represented by $-OG^1$ or $-NHG^2$, wherein $G^1$ represents a hydrogen atom or a group capable of being hydrolyzed to form a hydroxy group, preferably a hydrogen atom or a group represented by $$-\overset{O}{\overset{\|}{C}}G^3 \text{ or } -\overset{O}{\overset{\|}{C}}-O-G^3$$

(wherein $G^3$ represents an alkyl group, particularly an alkyl group containing 1 to 18 carbon atoms such as a methyl group, an ethyl group, a propyl group, or the like, a halogen-substituted alkyl group containing 1 to 18 carbon atoms such as a trifluoromethyl group, a phenyl group or a substituted phenyl group), and $G^2$ represents a hydrogen atom, an alkyl group containing 1 to 22 carbon atoms, or a hydrolyzable group. Preferred examples of said hydrolyzable group, $G^2$, are groups represented by $$-\overset{O}{\overset{\|}{C}}-G^4,$$

$-SO_2G^5$, or $-SOG^5$ wherein $G^4$ represents an alkyl group containing 1 to 4 carbon atoms such as a methyl group; a halogen-substituted alkyl group such as a mono-, di- or trichloromethyl group, a trifluoromethyl group, or the like; an alkylcarbonyl group such as an acetyl group; an alkyloxy group; a substituted phenyl group such as a nitrophenyl group or a cyanophenyl group; a phenyloxy group unsubstituted or substituted with a lower alkyl group or halogen atom; a carboxy group; an alkyloxycarbonyl group; an aryloxycarbonyl group; or an alkylsulfonylethoxy or arylsulfonylethoxy group; and $G^5$ represents a substituted or unsubstituted alkyl or aryl group.

Further, b represents an integer of 0, 1, or 2, provided that b represents 1 or 2, preferably 1, except when $\alpha$ contains as $G^2$ in $-NHG^2$ described above an alkyl group which makes the compound represented by the general formula (A) immobile and non-diffusing, i.e., where $\alpha$ represents a group of $-CG^1$ or a group of $-NHG^2$ wherein $G^2$ represents a hydrogen atom, an alkyl group containing 1 to 8 carbon atoms, or a hydrolyzable group. Ball represents a ballast group which will be described in detail hereinafter.

Specific examples of this Y are described in U.S. Pat. Nos. 4,152,153, 3,928,312 and 3,993,638, and Japanese Patent Application (OPI) No. 50736/78.

Another example of Y is a group represented by the following formula (B):

(B)

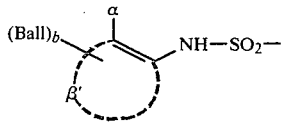

In the above formula, Ball, $\alpha$, and b are the same as defined with respect to formula (A), and $\beta'$ represents the atoms necessary for forming a carbocyclic ring like a benzene ring being optionally fused with a carbocyclic ring or a hetero ring to form a naphthalene ring, quinoline ring, a 5,6,7,8-tetrahydronaphthalene ring, a chroman ring, or the like. Further, the above-described ring may be substituted with a halogen atom, an alkyl group, an alkoxy group, an aryl group, an aryloxy group, a nitro group, an amino group, an alkylamino group, an arylamino group, an amido group, a cyano group, an alkylmercapto group, a keto group, a carboalkoxy group, a hetero ring group, or the like. Specific examples of this Y are described in U.S. Pat. Nos. 4,053,312 and 4,055,428.

As the further examples of Y there are illustrated the groups represented by the following general formula (C):

(C)

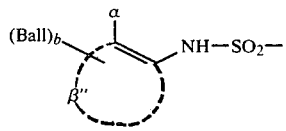

In the above formula, Ball, $\alpha$, and b are the same as defined with formula (A), and $\beta''$ represents atoms necessary for forming a hetero ring such as a pyrazole ring, a pyridine ring, or the like, said hetero ring optionally being further fused with a carbocyclic ring or a hetero ring and optionally being substituted with the same substituents as those described with respect to formula (B). Specific examples of this Y are described in Japanese Patent Application (OPI) No. 104343/76.

As the further examples of Y, there are illustrated groups represented by the general formula (D):

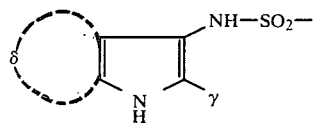

(D)

In the above formula, $\gamma$ preferably represents a hydrogen atom or a substituted or unsubstituted alkyl group, aryl group, or hetero ring, or —CO—$G^6$ wherein $G^6$ represents —$OG^7$, —S—$G^7$, or

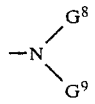

(wherein $G^7$ represents a hydrogen atom, an alkyl group, a cycloalkyl group, or an aryl group, the alkyl, cycloalkyl or aryl group being optionally substituted, $G^8$ represents the same group as $G^7$, or represents an acyl group derived from an aliphatic, aromatic, or sulfonic acid, and $G^9$ represents a hydrogen atom or a non-substituted or substituted alkyl group), and $\delta$ represents a residue necessary for completing a fused benzene ring which may have one or more substituents, said substituents or $\gamma$ and/or substituents on said fused benzene ring being or containing a ballast group. Specific examples of this Y are described in Japanese Patent Application (OPI) Nos. 104343/76 and 46730/78.

A further example of Y is represented by the general formula (E):

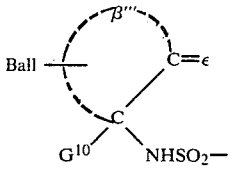

(E)

In the above formula, Ball is the same as with the formula (A), $\ominus$ represents an oxygen atom or =NG″ (wherein G″ represents a hydroxy group or an optionally substituted amino group) and, when $\epsilon$ represents =NG″, G″ typically represents G″ moiety in =C=N—G″ formed by the dehydration reaction between a carbonyl reagent of $H_2N$—G″ and a ketone group.

As the compound, $H_2N$—G″, used in the reaction, there are illustrated, for example, hydroxylamine, hydrazines, semicarbazides, thiosemicarbazides, etc. Specific examples of hydrazines include hydrazine, phenylhydrazine, substituted phenyl hydrazine having in the phenyl moiety thereof a substituent such as an alkyl group, alkoxy group, carboalkoxy group, halogen atom, etc., isonicotinic acid hydrazine, or the like. Semicarbazides include phenylsemicarbazide and substituted phenylsemicarbazides having a substituent such as an alkyl group, alkoxy group, carboalkoxy group, halogen atom, etc., and thiosemicarbazides include various derivatives as with semicarbazides.

$\beta'''$ in the above formula represents a 5-, 6- or 7-membered, substituted or unsubstituted non-aromatic carbocyclic ring. Specific typical examples thereof are, for example, cyclopentane, cyclohexanone, cyclohexanone, cyclopentenone, cycloheptanone, and cycloheptenone.

These 5- to 7-membered non-aromatic rings may be fused with other rings to form a fused ring. The other ring may be selected from various rings irrespective of aromaticity including carbocyclic rings and hetero rings and, in the case of a fused ring system, those wherein a benzene ring is fused with the above-described 5- to 7-membered non-aromatic hydrocarbyl ring such as indanone, benzocyclohexenone, benzocycloheptenone, etc., are preferred in the present invention.

The above-described 5- to 7-membered non-aromatic hydrocarbyl rings or the above-described fused rings may have one or more substituents such as an alkyl group, aryl group, alkyloxy group, aryloxy group, alkylcarbonyl group, aryl-carbonyl group, alkylsulfonyl group, arylsulfonyl group, halogen atom, nitro group, amino group, alkylamino group, arylamino group, amido group, alkylamido group, arylamido group, cyano group, alkylmercapto group, alkyloxycarbonyl group, etc.

$G^{10}$ represents a hydrogen atom or a halogen atom such as fluorine, chlorine, bromine, or the like. Specific examplee of this Y are described in Japanese Patent Application (OPI) No. 3819/78.

Y is also illustrated as described in U.S. Pat. Nos. 3,443,943, 3,751,406, 3,443,939, 3,443,940, 3,628,952 and 3,844,785, etc.

Other type of compounds represented by the general formula (I) are diffusion-resistant dye image-providing materials which release a diffusible dye under alkaline conditions due to intramolecular ring closure or the like but which, when reacting with an oxidation product of a developing agent, does not substantially release the dye. As an example of this Y, there is illustrated, for example, formula (F):

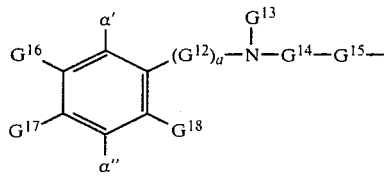

(F)

In the above formula, $\alpha'$ represents an oxidizable nucleophilic group such as a hydroxy group, a primary or secondary amino group, a hydroxyamino group, a sulfonamido group, etc., or the precursor thereof, with hydroxy group being preferred.

$\alpha''$ represents a dialkylamino group or an optional one selected from those defined for $\alpha'$, with hydroxy group being preferred. $G^{14}$ represents an electrophilic group such as —CO—, —CS—, etc., with —CO— being preferred. $G^{15}$ represents an oxygen atom, a sulfur atom, a selenium atom, a nitrogen atom, or the like and, when $G^{15}$ represents a nitrogen atom, it may be substituted by a hydrogen atom, an alkyl or substituted alkyl group containing 1 to 10 carbon atoms, or an aromatic compound residue containing 6 to 20 carbon atoms. Preferably, $G^{15}$ represents an oxygen atom. $G^{14}$ represents an alkylene group containing 1 to 3 carbon atoms, and a represents 0 or 1, preferably 0. $G^{13}$ represents a substituted or unsubstituted alkyl group containing 1 to 40 carbon atoms or a substituted or unsubstituted aryl group containing 6 to 40 carbon atoms, with alkyl group being preferred. $G^{16}$, $G^{17}$, and $G^{18}$ each represents a hydrogen atom, a halogen atom, a carbonyl group, a sulfamyl group, a sulfonamido group, an alkyloxy group containing 1 to 40 carbon atoms or that defined for $G^{13}$, and $G^{16}$ and $G^{17}$ may be taken together to form a 5- to 7-membered ring, and $G^{17}$ may represent

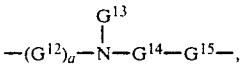

provided that at least one of $G^{13}$, $G^{16}$, $G^{17}$, and $G^{18}$ represents a ballast group. Specific examples of this type Y are described in U.S. Pat. No. 3,980,479.

Y is further illustrated by the formula (G):

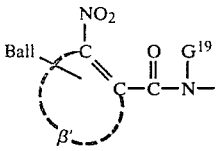

(G)

wherein Ball and $\beta'$ are the same as defined with the formula (B), and $G^{19}$ represents an alkyl group (including substituted alkyl group). Specific examples of this type Y are described in Japanese Patent Application (OPI) No. 35533/78.

As Y suited for this type compound, there are further illustrated the groups represented by the formula (H):

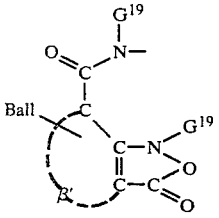

(H)

wherein Ball and $\beta'$ are the same as defined with the formula (B), and $G^{19}$ is the same as defined with the formula (G). Specific examples of this type Y are described in Japanese Patent Application (OPI) Nos. 11628/74 and 4819/77.

The ballast group is an organic ballast group which can make the dye image-providing material diffusion-resistant even during development in an alkaline processing solution, and preferably contains a hydrophobic group having 8 to 32 carbon atoms. Such an organic ballast group is bound to the dye image-providing material directly or through a linking group (for example, one of, or a combination of, an imino bond, an ether bond, a thioether bond, a carbonamido bond, a sulfonamido bond, a ureido bond, an ester bond, an imido bond, a carbamoyl bond, a sulfamoyl bond, or the like).

Several specific examples of the ballast group are illustrated below: an alkyl or an alkenyl group (e.g., dodecyl group, octadecyl group, etc.), an alkoxyalkyl group (e.g., 3-(octyloxy)propyl described in Japanese Patent Publication No. 27563/64, 3-(2-ethylundecyloxy)propyl, etc.), an alkylaryl group (e.g., 4-nonylphenyl group, 2,4-di-tert-butylphenyl group, etc.), an alkylaryloxyalkyl group (e.g., 2,4-di-tert-pentylphenoxymethyl group, α-(2,4-di-tert-pentylphenoxy)propyl group, 1-(3-pentadecylphenoxy)ethyl group, etc.), an acylamidoalkyl group (e.g., those described in U.S. Pat. Nos. 3,337,344 and 3,418,129, 2-(N-butylhexadecanamidoethyl group, etc.), an alkoxyaryl or an aryloxyaryl group (e.g., 4-(n-octadecyloxy)phenyl group, 4-(4-n-dodecylphenyloxy)phenyl group, etc.), a residue having both a long-chained aliphatic alkyl or alkenyl group and a water-solubilizing group such as carboxy or sulfo group (e.g., 1-carboxymethyl-2-nonanedecenyl group, 1-sulfoheptadecyl group, etc.), an alkyl group substituted with ester group (e.g., 1-ethoxycarbonylheptadecyl group, 2-(n-dodecyloxycarbonyl)ethyl group, etc.), an aryl- or hetero ring-substituted alkyl group (e.g., 2-[4-(3-methoxycarbonyluneicosanamido)phenyl]ethyl group, 2-[4-(2-n-octadecylsuccinimido)phenyl]ethyl group, etc.), and an aryloxyalkoxycarbonyl-substituted aryl group (e.g., 4-[2-(2,4-di-tert-pentylphenyloxy)-2-methylpropyloxycarbonyl]phenyl group, etc.).

Of the above-described organic ballast groups, particularly preferred are those which are bound to a linking group as represented by the following general formulae:

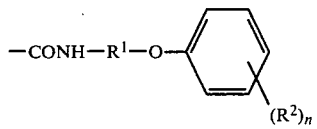

(III)

$$-CONH-R^1-O-R^3 \quad (IV)$$

$$-O-R^4 \quad (V)$$

$$-CONHR^3 \quad (VI)$$

In the above formulae, $R^1$ represents an alkylene group containing 1 to 10, preferably 1 to 6, carbon atoms such as a propylene or butylene group, $R^2$ represents a hydrogen atom or an alkyl group containing 1 to 10, preferably 1 to 6, carbon atoms such as a tert-amyl group, n represents an integer of 1 to 5 (preferably 1 or 2), $R^3$ represents an alkyl group containing 4 to 30, preferably 10 to 20, carbon atoms such as a dodecyl group, a tetradecyl group, or a hexadecyl group, and $R^4$ represents an alkyl group containing 8 to 30, preferably 10 to 20 carbon atoms (for example, a hexadecyl group, an octadecyl group, etc.), or a substituted alkyl group containing a total of 8 or more carbon atoms (wherein the alkyl moiety contains 1 or more carbon atoms, and substituents include a carbamoyl group, etc.).

Particularly effective of the groups described for Y above are N-substituted sulfamoyl groups. As the N-substituent in the N-substituted sulfamoyl groups, a carbon ring or a hetero ring group is desirable. Of the above-described Y, those represented by (A) and (B) are particularly preferred as examples of sulfamoyl groups N-substituted with a hydrocarbon ring. As the examples of N-hetero ring-substituted sulfamoyl groups, those represented by the formulae (C) and (D) are particularly preferred.

In addition to the compounds described in the Examples, there are illustrated, for example, the following compounds as the specific examples of the dye-releasing redox compounds:

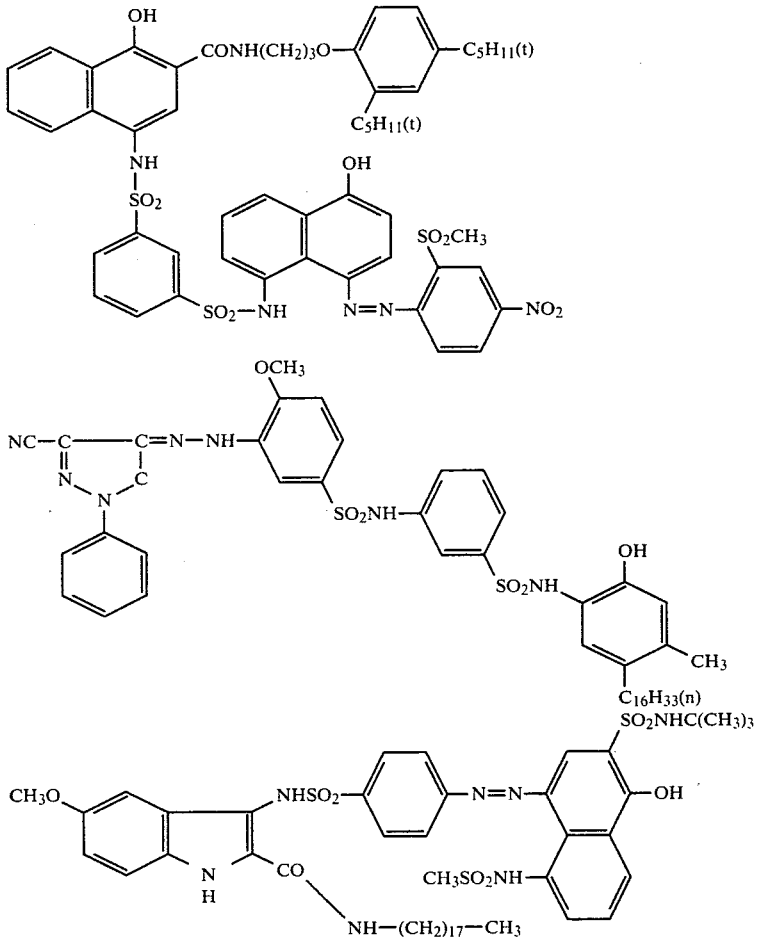

The dye-releasing redox compound is generally coated in conventional amounts in the present invention, i.e., about $1\times10^{-4}$ to $1\times10^{-2}$ mol/m$^2$ and preferably $2\times10^{-4}$ to $2\times10^{-3}$ mol/m$^2$.

The dye-releasing redox compound used in the present invention can be dispersed in a hydrophilic colloid vehicle in various manners according to the type of the compound. For example, compounds having a dissociative group such as a sulfo group or a carboxy group can be added to a hydrophilic colloid solution after being dissolved in water or an alkaline aqueous solution. Dye-releasing redox compounds slightly soluble in an aqueous medium and readily soluble in an organic solvent are first dissolved in an organic solvent, and the resulting solution is added to a hydrophilic colloid solution, followed by stirring or the like to disperse it as fine particles. As suitable solvents, there are illustrated ethyl acetate, tetrahydrofuran, methyl ethyl ketone, cyclohexanone, $\beta$-butoxy-$\beta$-ethoxyethyl acetate, dimethylformamide, dimethylsulfoxide, 2-methoxyethanol, tri-n-butyl phthalate, etc. Of these dispersing solvents, those with a comparatively low vapor pressure can be vaporized upon drying the photographic layers, or before coating according to the method described in U.S. Pat. Nos. 2,322,027 or 2,801,171. Of these dispersing solvents, those which are readily soluble in water can be removed by washing with water as described in U.S. Pat. Nos. 2,949,360 and 3,396,027.

In order to stabilize dispersion of the dye-releasing redox compound and accelerate the step of forming dye images, incorporation of a solvent substantially insoluble in water and showing a boiling point of 200° C. or higher under ordinary pressure in a photographic element together with the dye-releasing redox compound is advantageous. As the high-boiling solvents suited for this purpose, there are illustrated aliphatic esters such as higher fatty acid triglycerides, dioctyl adipate, etc.; phthalic acid esters such as di-n-butyl phthalate; phosphoric acid esters such as tri-o-cresyl phosphate, tri-n-hexyl phosphate, etc.; amides such as N,N-diethyllaurylamide; hydroxy compounds such as 2,4-di-n-amylphenol; and the like.

Further, incorporation of a polymer having affinity for a solvent in the photographic element together with a dye-releasing redox compound is favorable for stabilizing dispersion of the dye-releasing redox compound and accelerating the dye image-forming step. As the polymer having affinity for a solvent, there are illustrated shellac; phenol-formaldehyde condensate; poly-n-butyl acrylate; n-butyl acrylate-acrylic acid copolymer; n-butyl acrylate-styrene-methacrylamide terpolymer; etc. These polymers may be dispersed in a hydrophilic colloid after being dissolved in an organic solvent together with the dye-releasing redox compound, or a hydrosol of said polymer prepared through emulsion polymerization or like means may be added to a hydrophilic colloid dispersion of the dye-releasing redox compound. Dispersion of the dye-releasing redox compound can generally be attained by applying a large shearing force. For example, a high-speed rotary mixer, colloid mill, high pressure milk homogenizer, high pressure homogenizer described in British Pat. No. 1,304,264, ultrasonic wave emulsifying apparatus, and the like are useful. Dispersion of the dye-releasing redox compound is remarkably aided by using a surfactant as an emulsifying aid. As the surfactant useful for the dispersion of dye-releasing redox compound to be used in the present invention, there are illustrated anionic surfactants such as sodium triisopropylnaphthalenesulfonate, sodium dinonylnaphthalenesulfonate, sodium p-dodecylbenzenesulfonate, sodium dioctylsulfosuccinate, sodium cetylsulfate, and those described in Japanese Patent Publication No. 4293/64. Combined use of these anionic surfactants and higher fatty acid esters of anhydrohexytol provides particularly good emulsifying ability as described in U.S. Pat. No. 3,676,141.

The antistain agent used in the present invention can be dispersed in absolutely the same manner as the dye-releasing redox compound.

As the examples of the process for obtaining color diffusion transfer images using the dye-releasing redox compound, there is illustrated a process involving the following steps:

(A) imagewise exposing a photographic element comprising a support having provided thereon at least one light-sensitive silver halide emulsion layer associated with a dye-releasing redox compound;
(B) spreading an alkaline processing solution on the light-sensitive silver halide emulsion layer to develop the light-sensitive silver halide;
(C) cross-oxidizing the dye-releasing redox compound with the oxidation product of the developing agent produced in proportion to the exposure amount;
(D) cleaving an oxidation product of said dye-releasing redox compound to release a diffusible dye; and
(E) diffusion of the released dye image to an image-receiving layer (in direct or indirect contact with the light-sensitive layer) to form a transferred image thereon.

In the above-stated process, any silver halide-developing agent that is able to cross-oxidize the dye-releasing redox compound can be used. Such developing agent may be incorporated in an alkaline processing composition or in an appropriate layer of the photographic element. Examples of the developing agent usable in the present invention include hydroquinones, aminophenols (e.g., N-methylaminophenol), pyrazolidones (e.g., phenidone, dimezone (1-phenyl-4,4-dimethyl-3-pyrazolidone), 1-phenyl-4-methyl-4-hydroxymethyl-3-pyrazolidone, etc.), phenylenediamines (e.g., N,N-diethyl-p-phenylenediamine, 3-methyl-N,N-diethyl-p-phenylenediamine, 3-methoxy-N-ethoxy-p-phenylenediamine, etc.), and the like.

Of these, black-and-white developing agents forming less stain in an image-receiving lyaer are generally more preferred than color developing agents such as phenylenediamines.

In addition, the alkaline processing composition may contain compounds capable of accelerating development or diffusion of the dye, such as benzyl alcohol.

A conventional image-receiving layer, neutralizing layer, neutralization rate-adjusting layer (timing layer), and processing composition can be used in the present invention such as described in, for example, Japanese Patent Application (OPI) No. 64533/77.

The photographic element of the present invention preferably takes the form of photographic film unit which is constructed so that it can be photographically processed, after imagewise exposure, by passing it between a pair of juxtaposed pressure-applying members.

One embodiment of the film unit of the type of being superposed one over the other which is the most recommendable in appyling the present invention is disclosed in Belgian Pat. No. 757,959. According to this embodiment, an image-receiving layer, a substantially opaque reflective layer (for example, titanium dioxide layer and carbon black layer), and aforesaid single or plural light-sensitive layers are coated in sequence on a transparent support, then a transparent cover sheet is superposed thereon in a face-to-face arrangement. A rupturable container retaining an alkaline processing composition containing an opacifying agent (e.g., carbon black) for intercepting light is positioned adjacent the uppermost layer (protective layer) of the above-stated light-sensitive layers and the transparent cover sheet. Such film unit is imagewise exposed through the transparent cover sheet and, upon withdrawal from the camera, the container is ruptured by pressure-applying members to spread the processing composition (containing an opacifying agent) evenly between the light-sensitive layer and the cover sheet. Thus, the light-sensitive element is shielded from light in a sandwiched form, and development proceeds in a bright room.

It is recommended to incorporate a neutralizing mechanism in the film units of these embodiments as has been described before. Above all, it is preferred to provide a neutralizing layer in the cover sheet (if desired, a timing layer is provided on the side on which the processing solution is to be spread).

Another useful laminate-integrated forms permitting to use the photographic element having the stratum structure of the present invention are described in U.S. Pat. Nos. 3,415,644, 3,415,645, 3,415,646, 3,647,487, 3,635,707 and 3,993,486, etc.

Accordingly, in accordance with one embodiment of the present invention, the color diffusion transfer photographic element comprises a transparent support having provided thereon in sequence at least an image-receiving layer, a light-intercepting layer, a reflective layer, a cyan dye-releasing redox compound-containing layer associated with a red-sensitive silver halide emulsion, an antistain agent-containing layer, a spacer layer, a magenta dye-releasing redox compound-containing layer associated with a green-sensitive silver halide emulsion layer, an antistain agent-containing layer, a spacer layer, and a yellow dye-releasing redox compound-containing layer associated with a blue-sensitive silver halide emulsion, which provides a color image when processed with an alkaline processing solution to form an oxidation product of a developing agent through development of silver halide which, in turn, causes a redox reaction with the dye-releasing redox compounds and forms an imagewise distribution of diffusible dyes, followed by the dyes diffusing into the image-receiving layer to form a color image, where the spacer layer is essentially gelatin or a silver halide emulsion layer having the same color sensitivity as that of the associated silver halide emulsion. In the above layer sequence the dye-releasing redox compound-containing layer and associated silver halide emulsion is preferably constructed of a silver halide emulsion layer and a dye-releasing redox compound-containing layer with the silver halide emulsion layer opposite side the image-receiving layer with respect to the dye-releasing redox compound-containing layer.

EXAMPLE 1

On a transparent polyethylene terephthalate film support were coated the following layers in the following order to prepare light-sensitive element I.

(1) An image-receiving layer containing 4.0 g/m$^2$ of copoly[styrene-N-vinylbenzyl-N,N,N-trihexylammonium chloride] and 4.0 g/m$^2$ of gelatin.

(2) A white reflective layer containing 22 g/m$^2$ of titanium dioxide and 2.2 g of gelatin.

(3) An opaque layer containing 2.7 g/m$^2$ of carbon black and 2.7 g/m$^2$ of gelatin.

(4) A layer containing 0.50 g/m$^2$ of a cyan dye-releasing redox compound of the following structure, 0.50 g/m$^2$ of N,N-diethyllaurylamide, and 1.5 g/m$^2$ of gelatin.

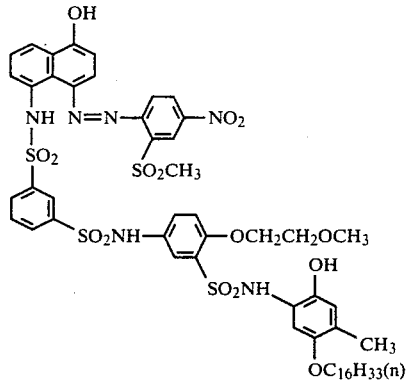

(5) A layer containing a red-sensitive internal latent image-forming emulsion (gelatin: 1.1 g/m$^2$; silver: 1.4 g/m$^2$), 0.015 g/m$^2$ of 1-acetyl-2-[4-(2,4-di-t-pentylphenoxyacetamido)phenyl]hydrazine, and 0.067 g/m$^2$ of sodium 2-pentadecylhydroquinone-5-sulfonate.

(6) An antistain agent-containing layer containing 1.0 g/m$^2$ of gelatin, 1.0 g/m$^2$ of 2,5-di-t-pentadecylhydroquinone, and 0.5 g/m$^2$ of tricresyl phosphate.

(7) A spacer layer of the present invention containing 0.5 g/m$^2$ of gelatin.

(8) A layer containing 0.80 g/m$^2$ of a magenta dye-releasing redox compound of the following structure, 0.20 g/m$^2$ of N,N-diethyllaurylamide, and 1.2 g/m$^2$ of gelatin.

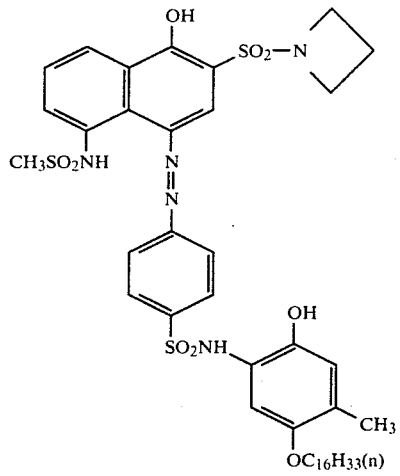

Magenta dye-releasing redox compound (9) A layer containing a green-sensitive, internal latent image-forming silver bromoiodide emulsion (gelatin: 1.1 g/m$^2$; silver: 1.4 g/m$^2$), 0.015 g/m$^2$ of 1-acetyl-2-[4-(2,4-di-t-pentylphenoxyacetamido)phenyl]hydrazine, and 0.067 g/m$^2$ of sodium 2-pentadecylhydroquinone-5-sulfate.

(10) An antistain agent-containing layer containing 1.0 g/m$^2$ of gelatin, 1.0 g/m$^2$ pg 2.5-di-t-pentadecylhydroquinone, and 0.5 g/m$^2$ of tricresyl phosphate.

(11) A spacer layer of the present invention containing 0.5 g/m$^2$ of gelatin.

(12) A layer containing 1.0 g/m$^2$ of a yellow dye-releasing redox compound having the following structure, 0.25 g/m$^2$ of N,N-diethyllaurylamide, and 1.0 g/m$^2$ of gelatin.

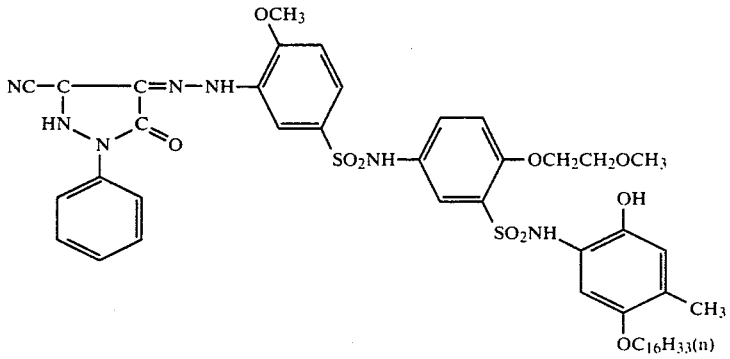

Yellow dye-releasing redox compound

(13) A layer containing a blue-sensitive, internal latent image-forming silver bromoiodide emulsion (gelatin: 1.1 g/m$^2$; silver: 1.4 g/m$^2$), 0.015 g/m$^2$ of 1-acetyl-2-[4-(2,4-di-t-pentylphenoxyacetamido)phenyl]hydrazine, and 0.067 g/m$^2$ of sodium 2-pentadecylhydroquinone-5-sulfonate.

(14) A protective layer containing 1.3 g/m$^2$ of gelatin, 0.9 g/m$^2$ of polyethyl acrylate latex, 0.5 g/m$^2$ of Tinuvin, and 0.026 g/m$^2$ of a hardening agent of triacryloylperhydrotriazine.

As a comparative sample for photographic element (I) of the present invention, comparative photographic element (II) was prepared in the same manner as with sample (I) except omitting spacer layers (7) and (11) from photographic element (I).

A cover sheet was prepared by coating on a transparent polyethylene terephthalate film support the following layers in the following order.

(1) A neutralizing layer comprising polyacrylic acid (10 g/m$^2$).

(2) A timing layer comprising acetyl cellulose (10 g/m$^2$).

For the purpose of comparing storage stability of photographic element (I) with that of (II), each photographic element was subjected to the tests on photographic properties after storing for 3 days from 1 week after coating, under the conditions of 45° C. and 70% RH or under room conditions (25° C., 50% RH). Each photographic element was exposed through an optical wedge with a density difference of 0.2 using a 2854° K. tungsten light (maximum exposure amount: 10 CMS).

The exposed photographic element and a pod-like container retaining the following viscous processing solution were passed between a pair of juxtaposed, pressure-applying rollers to uniformly spread the processing solution between the element and the above-stated cover sheet.

Composition of the viscous processing solution:

| | |
|---|---|
| Water | 820 cc |
| 1N $H_2SO_4$ | 5 cc |
| Hydroxyethyl Cellulose | 60 g |
| 4-Hydroxymethyl-4-methyl-1-phenyl-3-pyrazolidone | 5 g |
| 5-Methylbenzotriazole | 2 g |
| t-Butylhydroquinone | 0.4 g |
| Sodium Sulfite | 2 g |
| Carbon Black | 150 g |
| Sodium Hydroxide | 30 g |

One hour after the spreading of the processing solution, image density was measured to obtain the results shown in Table 1.

Table 1 shows that photographic element (I) of the present invention containing the spacer layers suffered less reduction in yellow density and magenta density when stored for 3 days at 45° C. and 70% RH, as compared with photographic element (II), thus being excellent in preservability.

TABLE 1

| | Storage Conditions | | | |
|---|---|---|---|---|
| | 25° C., 50% RH for 3 Days Reflection Density after 1 Hour | | 45° C., 70% RH for 3 Days Reflection Density after 1 Hour | |
| | $D_{max}$ | $D_{min}$ | $D_{max}$ | $D_{min}$ |
| Photographic Element (I) | | | | |
| Yellow Density | 1.82 | 0.26 | 1.81 | 0.26 |
| Magenta Density | 1.92 | 0.26 | 1.92 | 0.26 |
| Cyan Density | 1.80 | 0.29 | 1.80 | 0.29 |
| Comparative Photographic Element (II) | | | | |
| Yellow Density | 1.75 | 0.26 | 1.05 | 0.26 |
| Magenta Density | 2.02 | 0.26 | 1.40 | 0.26 |
| Cyan Density | 1.95 | 0.30 | 1.70 | 0.30 |

Also, microscopic observation of cross section of each sample having been stored for three days at 45° C. and under 70% RH revealed that, in photographic element (I), the magenta dye-providing material and the yellow dye-providing material did not migrate into the antistain agent-containing layer whereas, in photographic element (II), they partly migrated.

EXAMPLE 2

On a transparent polyethylene terephthalate film support were coated, in sequence, the following layers to prepare photographic element (III) in accordance with the present invention.

(1) The image-receiving layer of Example 1.

(2) The white, reflective layer in Example 1.

(3) The opaque layer in Example 1.

(4) An antistain agent-containing layer containing 1.0 g/m$^2$ of gelatin, 1.0 g/m$^2$ of 2,5-di-t-pentadecylhydroquinone, and 0.5 g/m$^2$ of tricresyl phosphate.

(5) A spacer layer of the present invention containing 0.25 g/m$^2$ of gelatin.

(6) A layer containing 0.9 g/m$^2$ of the same yellow dye-releasing redox compound and 1.0 g/m$^2$ of gelatin.

(7) A layer containing a blue-sensitive, internal latent image-forming silver bromoiodide emulsion (gelatin: 1.7 g/m$^2$; silver: 2.2 g/m$^2$), 0.15 mg/m$^2$ of 1-formyl-2-{4-[3-(3-phenylthioureido)benzamido]phenyl}hydrazide, and 0.094 g/m$^2$ of sodium 2-pentadecylhydroquinone-5-sulfonate.

(8) A protective layer of gelatin (0.5 g/m$^2$).

As a comparative sample for photographic element (III) of the present invention, comparative photographic element (IV) was prepared in the same manner as photographic element (III) except omitting spacer layer (5) from photographic element (III). Photographic elements (III) and (IV) were subjected to the same storage stability tests as in Example 1.

After imagewise exposure and spreading of the processing in the same manner as in Example 1, the photographic element of each sample was delaminated from the cover sheet, followed by removing the processing solution adhering to it and immersed in a fixing solution (F-5) for 10 minutes then washed with water for 10 minutes. After drying, densities of the samples and, at the same time, silver deposit amounts were measured using fluorescent X-ray.

With each sample, transfer density corresponding to a definite silver amount of 0.6 g/m$^2$ was determined by interpolation based on measured silver deposit amounts and corresponding transfer densities. Thus, there were obtained the following results.

Table 2 shows that photographic element (III) of the present invention underwent almost no change in density corresponding to a definite silver amount after being stored for 3 days at 45° C. and under 70% RH, whereas comparative photographic element (IV) underwent considerable change in density. This shows that the spacer layer in photographic element (III) of the present invention serves to correctly convert silver deposit to dye even after storage under severe conditions. The correct conversion of the silver deposit to dye leads to the presumption that the dye image-providing materials and/or the antistain agent did not migrate from layer to layer under the conditions of storing for 3 days at 45° C. under 70% RH.

TABLE 2

| Photographic Element | 25° C., 50% RH for 3 Days Reflection Density (corresponding to silver deposit amount of 0.6 g/m$^2$) | 45° C., 70% RH for 3 Days Reflection Density (corresponding to silver deposit amount of 0.6 g/m$^2$) |
|---|---|---|
| (III) Yellow Density | 1.34 | 1.32 |
| (IV) Yellow Density | 1.37 | 0.60 |

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic element comprising a group of layers consisting essentially of, in sequence, a silver halide photographic emulsion layer, a dye releasing redox compound-containing layer associated with the silver halide photographic emulsion and capable of releasing a diffusible dye as a result of a redox reaction with the oxidation product of a developing agent produced by the development of silver halide with an alkaline processing solution, a spacer layer and a layer containing a ballasted anti-stain agent, the said spacer layer being a layer essentially containing a hydrophilic colloid or a silver halide emulsion layer having substantially the same spectral sensitivity as that of the associated silver halide emulsion.

2. The photographic element of claim 1, wherein said photographic element contains three dye-releasing redox compound-containing layers and associated silver halide emulsions divided by antistain agent-containing layers, which provide cyan, magenta and yellow dye images, respectively.

3. The photographic element of claim 2, wherein a spacer layer is located between said magenta dye-releasing redox compound-containing layer and an antistain agent-containing layer and a spacer layer is located between said yellow dye-releasing redox compound-containing layer and an antistain agent-containing layer.

4. The photographic element of claims 1 or 3, wherein said spacer layer is essentially a hydrophilic colloid layer.

5. The photographic element of claim 4, wherein said hydrophilic colloid is gelatin.

6. The photographic element of claims 1 or 3, wherein said spacer layer is a silver halide emulsion layer.

7. The photographic element of claim 1, wherein said spacer layer is about 0.05 to 5$\mu$ thick.

8. The photographic element of claim 1, wherein said dye-releasing redox compound-containing layer contains oil-soluble additives which are liquid at temperatures of about 45° C. or higher in an amount of not less than one half the amount of gelatin in the dye-releasing redox compound-containing layer.

9. The photographic element of claim 1, wherein said dye-releasing redox compound and associated silver halide emulsion are a first layer containing said dye-releasing redox compound and a second layer containing said silver halide emulsion.

10. The photographic element of claim 5, wherein said spacer layer contains a thickener agent.

11. The photographic element of claim 1, wherein said antistain agent is a dihydroxybenzene derivative.

12. The photographic element of claim 11, wherein said dihydroxybenzene derivative is represented by the formula (I):

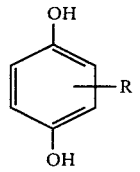

(I)

wherein R represents an alkyl group, an alkoxy group, an aryl group, an aryloxy group, a carbamoyl group, a sulfamoyl group, an acyl group, an alkoxycarbonyl group, a sulfo group or an aryloxycarbonyl group, within which the alkyl or aryl moiety may be substituted by at least one substituent selected from the group consisting of a halogen atom, an alkyl group, an aryl group, an alkoxy group, an aryloxy group, a carboxy group, an alkoxycarbonyl group, an aryloxycarbonyl group, an acyl group, an acyloxy group, a carbamoyl group, a sulfo group, a sulfamoyl group, a sulfonamido group, an N-alkylamino group, an N-arylamino group, an acylamino group, an imido group, and a hydroxy group; and one to three of the remaining hydrogen atoms on the hydroquinone nucleus may be substituted by another R group which may be the same or different from the first.

13. The photographic element of claim 1, wherein said element comprises a transparent support having provided thereon in sequence at least an image-receiving layer, a light-intercepting layer, a reflective layer, a cyan dye-releasing redox compound-containing layer associated with a red-sensitive silver halide emulsion, an antistain agent-containing layer, a spacer layer, a magenta dye-releasing redox compound-containing layer associated with a green-sensitive silver halide emulsion layer, an antistain agent-containing layer, a spacer layer, and a yellow dye-releasing redox compound-containing layer associated with a blue-sensitive silver halide emulsion, which provides a color image when processed with an alkaline processing solution to form an oxidation product of a developing agent through development of silver halide which, in turn, causes a redox reaction with the dye-releasing redox compounds and forms an imagewise distribution of diffusible dyes, followed by the dyes diffusing into the image-receiving layer to form a color image, said spacer layer containing essentially gelatin or being a silver halide emulsion layer having the same color sensitivity as that of the associated silver halide emulsion.

14. The photographic element of claim 13, wherein said dye-releasing redox compound-containing layers and associated silver halide emulsions are a first layer containing said dye-releasing redox compound and a second layer of said silver halide emulsion in which the dye-releasing redox compound-containing layer is positioned nearest the image-receiving layer.

15. The photographic element of claim 1, comprising in sequence from the topmost layer: a protective layer, a blue-sensitive silver halide emulsion layer, a yellow dye-releasing redox compound-containing layer, a spacer layer, a layer containing a diffusion-resistant, antistain agent, a green-sensitive silver halide emulsion layer, a magenta dye-releasing redox compound-containing layer, a spacer layer, a layer containing a diffusion-resistant antistain agent, a red-sensitive silver halide emulsion layer, a cyan dye-releasing redox compound-containing layer, a light-intercepting layer containing a black pigment, a reflective layer containing a white pigment, a mordant layer containing a dye-mordanting agent.

* * * * *